US012031399B2

(12) United States Patent
Innes

(10) Patent No.: US 12,031,399 B2
(45) Date of Patent: Jul. 9, 2024

(54) TOOL PART

(71) Applicant: SPEX GROUP HOLDINGS LIMITED, Aberdeen (GB)

(72) Inventor: Martin Derrick Innes, Aberdeen (GB)

(73) Assignee: SPEX GROUP HOLDINGS LIMITED, Aberdeen (GB)

( * ) Notice: Subject to any disclaimer, the term of this patent is extended or adjusted under 35 U.S.C. 154(b) by 48 days.

(21) Appl. No.: 17/776,571

(22) PCT Filed: Nov. 12, 2020

(86) PCT No.: PCT/EP2020/081962
§ 371 (c)(1),
(2) Date: May 12, 2022

(87) PCT Pub. No.: WO2021/094484
PCT Pub. Date: May 20, 2021

(65) Prior Publication Data

US 2022/0356775 A1 Nov. 10, 2022

(30) Foreign Application Priority Data

Nov. 13, 2019 (GB) ..... 1916501.8

(51) Int. Cl.
*E21B 29/02* (2006.01)
*E21B 43/1185* (2006.01)

(52) U.S. Cl.
CPC ..... *E21B 29/02* (2013.01); *E21B 43/1185* (2013.01)

(58) Field of Classification Search
CPC ..... E21B 29/00; E21B 43/1185; E21B 29/02
See application file for complete search history.

(56) References Cited

U.S. PATENT DOCUMENTS 4,352,397 A 10/1982 Christopher
2003/0070812 A1* 4/2003 Robertson ..... E21B 29/02 166/63
2004/0089450 A1* 5/2004 Slade ..... E21B 41/0078 166/55.7

FOREIGN PATENT DOCUMENTS

GB 2532609 A 5/2016
WO 2016069305 A1 5/2016
(Continued)

OTHER PUBLICATIONS

International Search Report and Written Opinion for corresponding PCT Application No. PCT/EP2020/081962, mailed Feb. 17, 2021.
(Continued)

*Primary Examiner* — Caroline N Butcher
(74) *Attorney, Agent, or Firm* — TAROLLI, SUNDHEIM, COVELL & TUMMINO L.L.P.

(57) ABSTRACT

A tool (1) for manipulating a target (12) with combustion products from a propellant has a housing (2) including at least one outlet (5) for combustion products from at least one propellant source (16) contained within. An ignition mechanism (18) is provided for igniting propellant at the propellant source. The outlet (5) includes a plurality of exit ports (6, 8) on a surface of the tool that is configured to direct combustion products at a target. The plurality of exit ports includes a principal exit port (6) and one or more secondary exit ports (8). The secondary exit port (8) or ports are spaced apart from and at least partly surround the principal exit port (6). A method for manipulating a target with the tool is provided.

18 Claims, 8 Drawing Sheets

(56) References Cited

FOREIGN PATENT DOCUMENTS

| | | | | |
|---|---|---|---|---|
| WO | WO-2016069305 | A1 * | 5/2016 | ..... E21B 29/02 |
| WO | WO-2017199037 | A1 * | 11/2017 | ..... E21B 29/02 |

OTHER PUBLICATIONS

EP Examination Report for corresponding European Application Serial No. 20816082, dated Jan. 16, 2024, pp. 1-4.

* cited by examiner

TOOL PART

RELATED APPLICATIONS

The present invention is a U.S. National Stage under 35 USC 371 patent application, claiming priority to Serial No. PCT/EP2020/081962, filed on 12 Nov. 2020; which claims priority from 1916501.8 filed 13 Nov. 2019; the entirety of which are incorporated herein by reference.

FIELD

The present invention relates to the field of manipulation of a target with combustion products from a propellant. The present invention finds particular application in the oil and gas industry and is particularly suitable for the manipulation of solid material targets, such as tubulars.

BACKGROUND

There are situations in which it is desirable to manipulate a target particularly in remote locations such as inside an oil or gas well.

A typical situation may be to sever a tubular in a well, clean a downhole device or tubulars, initiate a downhole tool or remove an obstruction.

Conventional tools perform these operations with varying degrees of success but generally they are not particularly efficient and make such operations expensive and time consuming. They may, additionally, have associated ancillary equipment that is cumbersome or may attract stricter logistical or regulatory controls.

The present applicant's international patent application, published as WO2017/199037, describes making use of a stream of combustion products from a propellant source to carry out operations such as severing a tubular.

Improved tools such as described in the present applicant's international patent applications WO2016/166531 and WO2016/079512 make use of explosive propellants. Propellants are materials that are generally classified as an explosive for transportation purposes. Thus, a propellant is a generally explosive material which has a low rate of combustion and once ignited burns or otherwise decomposes (i.e. deflagrates) to produce propellant gas. This gas is highly pressurised, the pressure driving the gas and other combustion products away from the propellant, forming a stream of combustion products. A propellant can burn smoothly and at a uniform rate after ignition without depending on interaction with the atmosphere and produces propellant gas and/or heat on combustion; and may also produce additional combustion products. A propellant may take the form of a solid, a liquid or a gel for example.

There remains the desire for alternative and improved tools that may find use in challenging environments.

There are particular challenges in providing an effective tool that can be inserted downhole, including through restrictions such as valves or other narrowing of the bore. Tool retrieval and replacement may be difficult or even impossible in some circumstances. Therefore tools that can provide a high likelihood of successful deployment and operation, even in difficult conditions, are desired.

SUMMARY

According to a first aspect of the invention there is provided a tool for manipulating a target with combustion products from a propellant, the tool comprising:

a housing comprising at least one outlet for combustion products from at least one propellant source contained within the housing;

an ignition mechanism for igniting propellant at the propellant source;

wherein the outlet comprises a plurality of exit ports on a surface of the tool configured to direct combustion products at a target;

the plurality of exit ports comprising a principal exit port and one or more secondary exit ports, the secondary exit port or ports being spaced apart from and at least partly surrounding the principal exit port.

The secondary exit port or ports may be arranged to provide a jet or jets of combustion products that substantially surround or surround a jet of combustion products emanating from the principal exit port, in use of the tool.

The action of combustion products from the principal exit port on a target can be improved by the presence of the combustion products emanating from the secondary exit ports. Without wishing to be bound by theory it appears that the jet or jet of combustion products emanating from the secondary exit ports have a 'shrouding effect' on the jet of combustion products from the principal exit port. The shrouding effect may prevent or reduce disturbance of the jet from the principal exit port caused e.g. by turbulence in water between the tool and the target. An additional or alternative effect may be a reduction in cooling of the jet from the principal exit port i.e. a higher temperature of combustion products can reach the target in a tool using the shrouding effect.

Conveniently the housing defines one or more chambers and the propellant source or sources are located within the chamber or chambers. Ignited propellant can develop a pressure of combustion products within its respective chamber, which can then exit the tool via the respective exit port or ports. The pressure developed within a chamber is greater than the ambient (outside the tool) pressure. Typically, after some initial fluctuation, the tool can provide a steady state stream or jet of combustion products at least until the propellant source becomes depleted or exhausted. The combustion products exiting from the tool are typically at subsonic speeds, but in some circumstances may be supersonic.

The exit ports provide fluid communication from the chambers through the housing. The combustion products feeding the one or more secondary exit ports may be from a different propellant source or sources than that, or those, feeding the principal exit port.

The term 'propellant source' used herein means a location of propellant material provided for ignition. Thus, a propellant source within the chamber or chambers may comprise or be a charge (portion) of a propellant composition, or components for a propellant composition, placed at a location within the chamber. Alternatively, a propellant source may be an opening into the chamber from a supply system that feeds propellant composition, or the components for a propellant composition, for ignition. Feeding the tool with propellant allows the tool to be used continuously after ignition. The propellant may be fed into the housing in the form of a solid, liquid, paste, foam, gel or gas composition or a combination of these.

Conveniently the secondary exit ports may be fed with combustion products from the same chamber as provides combustion products to the principal exit port. Thus ignition of a propellant source or sources can provide a supply of combustion products in one chamber that exit from the principal exit port and its associated secondary exit port(s).

Where there is more than one outlet in a tool there can more than one principal exit port and respective secondary exit port(s) on the tool. Each outlet may be fed with combustion products from a single chamber. This can be convenient in manufacture and operation. The combustion products generated in the chamber can be directed by the principal and secondary exit ports from the chamber, with the manipulation of the target adjusted by the choice of exit port design. The shape, (internal and external) of the exit ports; together with their size and the pattern of their location on the tool can be used to achieve the desired effect on a target.

Thus the invention provides a tool for manipulating a target with combustion products from a propellant, the tool comprising:

- a housing defining a chamber;
- a propellant source located within the chamber;
- an ignition mechanism for igniting propellant at the propellant source; and
- at least one outlet from the chamber for combustion products from the propellant source;
- wherein the at least one outlet comprises a plurality of exit ports on a surface of the tool and configured to direct combustion products at a target;
- the plurality of exit ports comprising a principal exit port and one or more secondary exit ports, wherein the secondary exit port or ports are spaced apart from and at least partly surround the principal exit port.

Alternatively more than one chamber, where at least one propellant source is located, may be provided. Each chamber may supply combustion products to at least one of: a principal exit port; and a secondary exit port. Such arrangements can provide various options including supplying combustion products to a principal exit port and the associated secondary exit port(s) from different propellant sources located in different chambers. If desired different combustion products can be supplied to principal and associated secondary exit ports.

The manipulation of a target may be a change in temperature, structure, position, composition, phase, physical properties and/or condition of the material of the target; or any other characteristic of the material making up the target. The change in the material may be to, for example, ablate, erode, impact, clean and/or transmit heat. Severing or perforating the material of a target e.g. severing a tubular is an exemplary use. As an alternative the combustion products may be employed to repair a target, for example by depositing a coating carried by the combustion products.

The combustion products pressurise the chamber or chambers. The pressure and/or heat generated may be employed to open the exit ports. For example by melting a fusible material that closes an exit port before use. For further example by moving part of the tool relative to another and thereby uncovering or creating an exit port opening.

The housing may be generally elongate, typically generally cylindrical, as is common for downhole tools.

The arrangement of a principal exit port and one or more secondary exit ports surrounding (or at least partially surrounding) the principal exit port has been found to give improved results in manipulating a target, in particular when the stream of combustion products from the propellant source is directed by the exit ports through a dense medium such as water to the target—as is often the case in downhole operations. (The ambient pressure downhole can be high compared to atmospheric pressure.) The exit ports perform as nozzles for directing the combustion products at a target material.

The principal and secondary exit ports may be provided in various arrangements to suit the task in hand. For example the tool may be a perforating tool, for use in perforating tubulars, cement etc. to allow access to a rock formation. Such a tool may comprise at least one, typically a plurality, of outlets. Each outlet may comprise a principal exit port and associated secondary exit port(s); with the plurality of outlets distributed around the body of the tool. Each principal exit port may comprise a hole (e.g. a circular hole) through the housing and in communication with a chamber. Alternatively one or more, or each, principal exit port may be shaped to direct the stream of combustion products at the material to be manipulated. In some examples the principal exit port or ports may comprise a barrel i.e. an elongate tube. The elongate tube may be partially or even wholly within the housing of the tool. Such a structure may aid in directing the stream of combustion products towards a target. Each principal exit port may have an associated secondary exit port or ports to surround or partially surround it. Alternatively, in some examples secondary exit ports may be provided that surround or partially surround two or more of the principal exit ports.

Conveniently in tools where a principal exit port comprises a hole such as a circular hole, secondary exit ports may be provided in the form of an array of ports comprising holes spaced apart from the principal exit port and distributed around it, for example in a circular array. Alternatively a secondary exit port may comprise a slit in the housing that extends about, even completely surrounding a respective principal exit port.

For further example the tool may be a severing tool, for severing a tubular. Such a tool may have a principal exit port that comprises a circumferential slit, extending around the housing of the tool. To provide the desirable shrouding effect, two secondary exit ports may be provided; each comprising circumferential or substantially circumferential slits displaced axially, to either side of the principal exit port, on the housing.

Alternatively the two secondary exit ports may each be provided as arrays comprising e.g. circular holes extending circumferentially about the housing and axially displaced to either side of the principal exit port.

As a yet further alternative the severing tool may have an array of principal exit ports extending circumferentially about the housing of the tool. Secondary exit ports (comprising slits or arrays of holes as described above) displaced axially to either side of the circumferentially extending array of principal exit ports.

The principal exit port may be of a larger surface area than that of an associated secondary exit port. Arrangements that provide a circular array of secondary exit ports that are circular holes placed about a central principal exit port (that is itself a circular hole) are considered below with reference to specific embodiments. It has been found that arrangements where the principal exit port has a greater diameter than that of the associated secondary exit ports is effective in transmitting the heat from combustion products to the target. The circular principal exit port may have a diameter of from 1.5 to 4 times that of each associated secondary exit port or even more. The circular principal exit port may have a diameter of about twice that of each associated secondary exit port.

A tool may also comprise one or more conventional exit ports i.e. an exit port that is not a principal exit port or a secondary exit port as described herein.

The distance between an exit port and the material of a target (the 'stand-off') can be important in determining the effectiveness of a tool. For downhole use a tool may have to be relatively narrow in diameter, to allow it to pass constrictions in the bore as it is deployed adjacent a target location. To allow a reduction in stand-off distance the exit ports of a tool may be moveable radially outwards from a stowed position to a deployed position. For example the principal exit port and its associated secondary exit ports may be mounted to a part of the housing that can move radially outwards. The moving part may take the form of a piston (mounting the exit ports) moving in a radially directed cylinder of the housing. Conveniently movement may be achieved by pressure generated by combustion products from at least one propellant source, i.e. the piston forms a wall of a chamber including the propellant source.

The tools described herein may be provided with a centring mechanism to centre the tool in a bore. A centring mechanism may include one or more moving members, that move from a stowed position to a deployed position on the tool, to engage the wall of a bore. For example one or more arms that are stowed axially alongside or above or below the elongate housing of a tool and deploy by pivoting outwards to engage the wall of a bore. Such a mechanism including moving members may also be employed to locate the tool in an offset manner in a bore. For example off centre, or even angled with respect to the principal axis of the bore.

The tools described herein may include one or more sensors. For example to measure conditions inside and/or outside the tool, such as temperature or pressure. The tool may include sensors for determining if an attacked target, such as a tubular has been severed. For example conductivity or continuity of electrical signal measurement may be made across a zone in a tubular that should have been severed by the action of combustion products.

The tools described herein may also include a control system, typically mounted within the housing, for controlling operations and/or taking sensor measurements. Communication with the surface may be by wire or wirelessly.

According to a third aspect of the invention there is provided a method for manipulating a target, the method comprising:

deploying a tool for manipulating a target, as described herein, adjacent to the target; and igniting the propellant source or sources to generate combustion products that are directed at the target as they exit from the principal and secondary exit ports.

The tool for use in the method may take any of the features described herein for tools in accordance with the invention.

DETAILED DESCRIPTION OF THE DRAWINGS

Figure 1B:
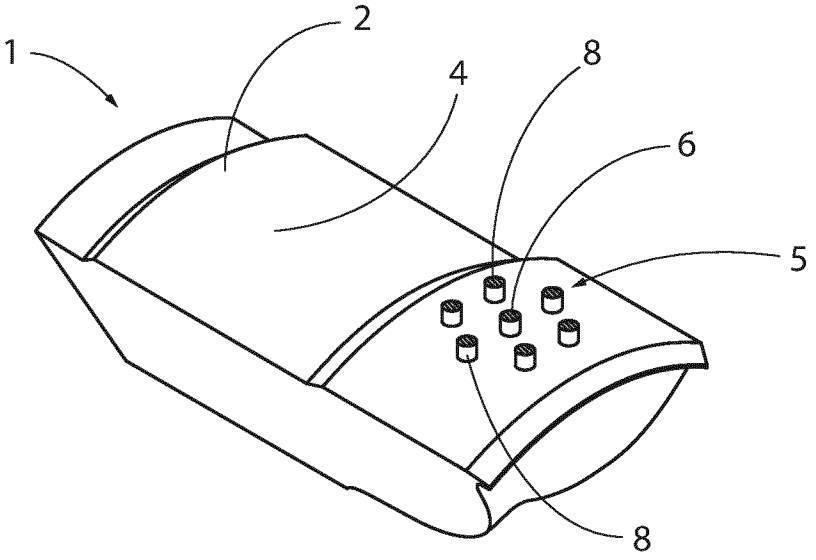
FIGS. 1*a*, 1*b*, and 1*c* show in schematic perspective views a portion of the exterior surface of the housing of a downhole tool.
Figure 1A:
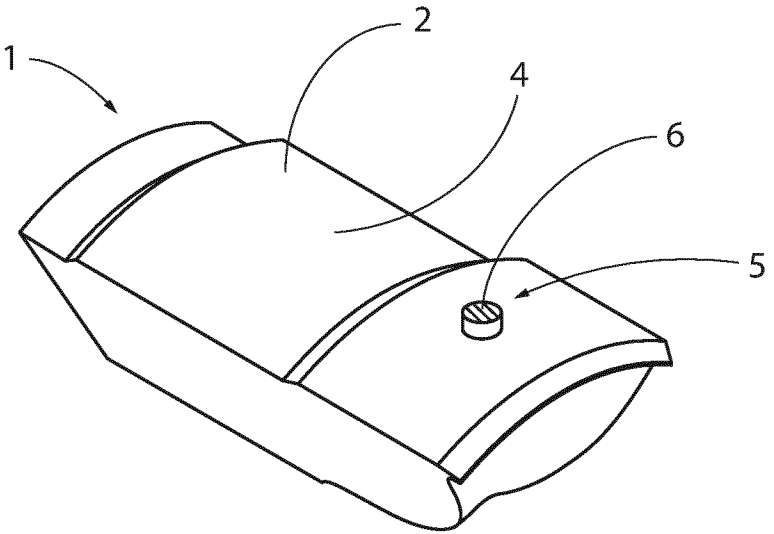
Figure 1C:
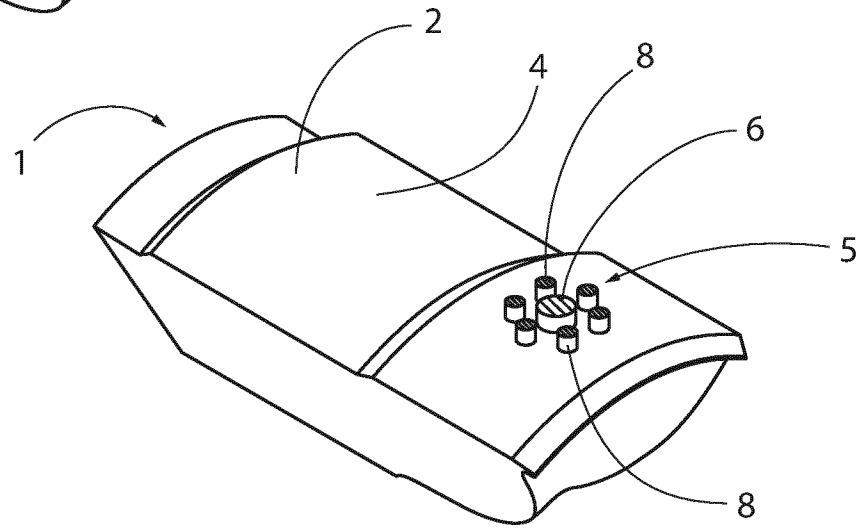

FIGS. 1*a*, 1*b* and 1*c* show in schematic perspective views a portion of the exterior surface of the housing 2 of a downhole tool 1. The tool is for perforating a tubular and is itself generally cylindrical, with a 2.5 inch outside diameter. The tool has six outlets for combustion products from a propellant source or sources. The outlets are symmetrically placed around its circumference, only one is depicted in these figures.

In FIG. 1*a*, the portion of the exterior surface 4 of the tool 1 has an outlet 5 consisting of a single principal exit port 6 (0.124 inch diameter) for communication with a chamber including a propellant source provided within the tool 1.

FIG. 1*b* is a similar view of the exterior surface 4 of a tool 1 except that the principal exit port 6 is surrounded by six spaced apart secondary exit ports 8, in a circular array. In FIG. 1*b* the principal and secondary exit ports 6, 8 all have the same diameter (0.062 inches).

FIG. 1*c* is a similar view of the exterior surface 4 of a tool 1 except that a larger principal exit port 6 (0.124 inch diameter—as in FIG. 1*a*) is surrounded by six spaced apart smaller secondary exit ports 8 (0.062 inch diameter), in a circular array.

In the analysis described below a mild steel target tubular having a 4.5 inch bore is attacked with combustion products emanating from exit ports provided on the tool and passing through water (a two inch layer in the annulus) to reach the target tubular.

Use of the exit port arrangements of FIGS. 1*a*, 1*b* and 1*c* have been analysed by Computational Fluid Dynamics (CFD) techniques. A 3D computer model was generated assuming the tool 1 is symmetrically located inside the target tubular, with water in the annulus in between. The symmetrical arrangement of the six outlets on the tool allows analysis by consideration of only ⅙th of the whole structure.

The model assumes that the outlets 5, consisting of exit ports 6, 8 are fed with gaseous combustion products produced in a chamber of the tool by combustion of a solid propellant charge with known characteristics.

Figure 2A:
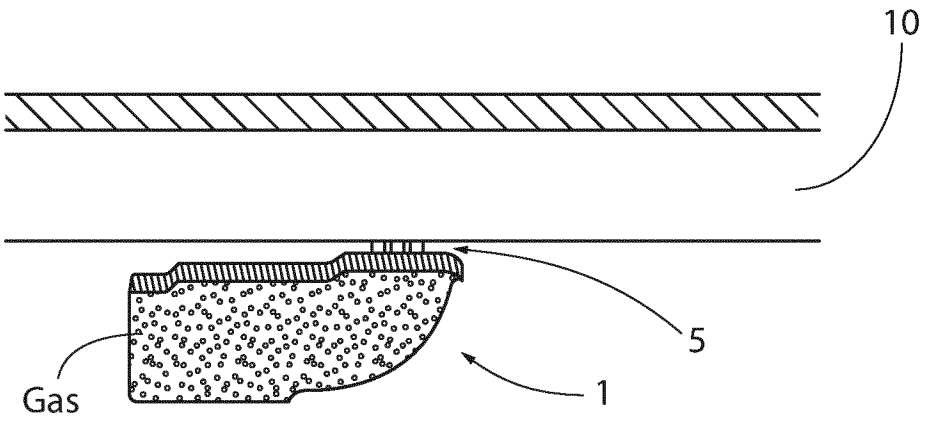
FIGS. 2*a* and 2*b* show in schematic cross section the operation of a tool in severing a tubular.

As shown in FIG. 2*a*, before combustion products emanate from the outlets 5 of the tool 1, the chamber of the tool is filled with gas and the annulus 10 with water.

Figure 2B:
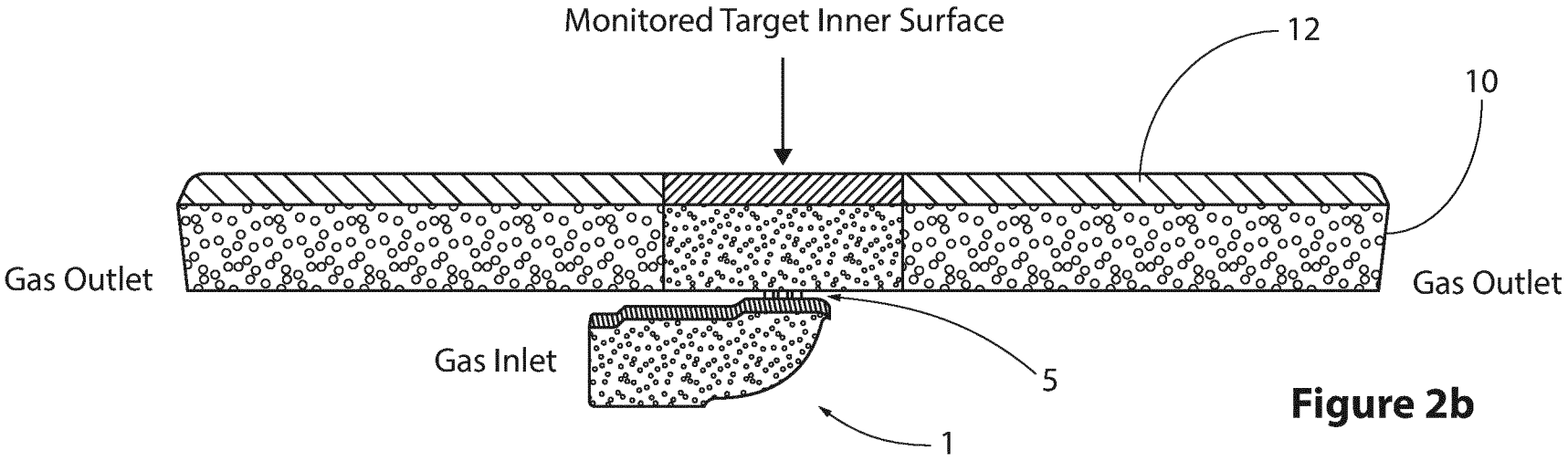

FIG. 2*b*, shows the situation when the tool is fully operational with combustion products directed at the inner surface of the target tubular 12. The annulus 10 is being filled with gaseous combustion products from a propellant source or sources. The gaseous combustion products can escape axially in either direction ('Gas Outlets'). The temperature of the inner surface of the target tubular 12 is monitored to determine the effectiveness of the attack made by the combustion products.

Figure 3:
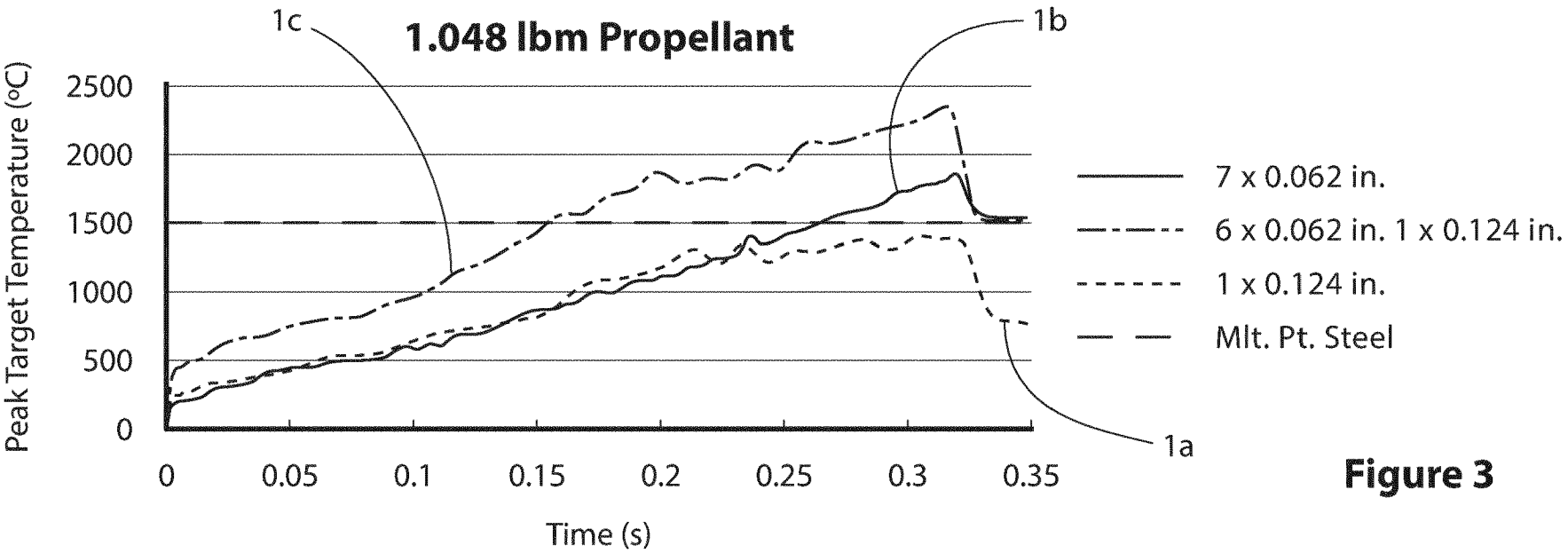
FIG. 3 shows graphically target temperature varying with time from simulations of using a tool to sever a tubular.

FIG. 3 shows a graph of target temperature varying with time in simulations where a solid propellant charge of 1.048 pounds (mass) combusts in the chamber of the tool over a duration of about 0.34 seconds. For reference, the melting point of a mild steel (1500° C.) is shown as a horizontal dashed line.

The three arrangements as depicted in FIGS. 1*a*, 1*b*, and 1*c* are considered.

As can be seen from the figure the arrangement of FIG. 1*a* (a principal exit port without secondary exit ports) produces the lowest peak temperature, not reaching the mild steel melting point. The arrangement of FIG. 1*b* (principal and secondary exit ports all having the same diameter) provides a significant improvement towards the end of the combustion period. The arrangement of FIG. 1*c* (larger principal exit port and smaller secondary exit ports) shows significantly higher temperature from near the beginning of the combustion period until the end. The melting temperature of mild steel is exceeded for about half of the combustion period and the highest temperature reached is about 2400° C.

These results show the effect of exit port arrangements with a given charge of propellant combustion.

Figure 4A:
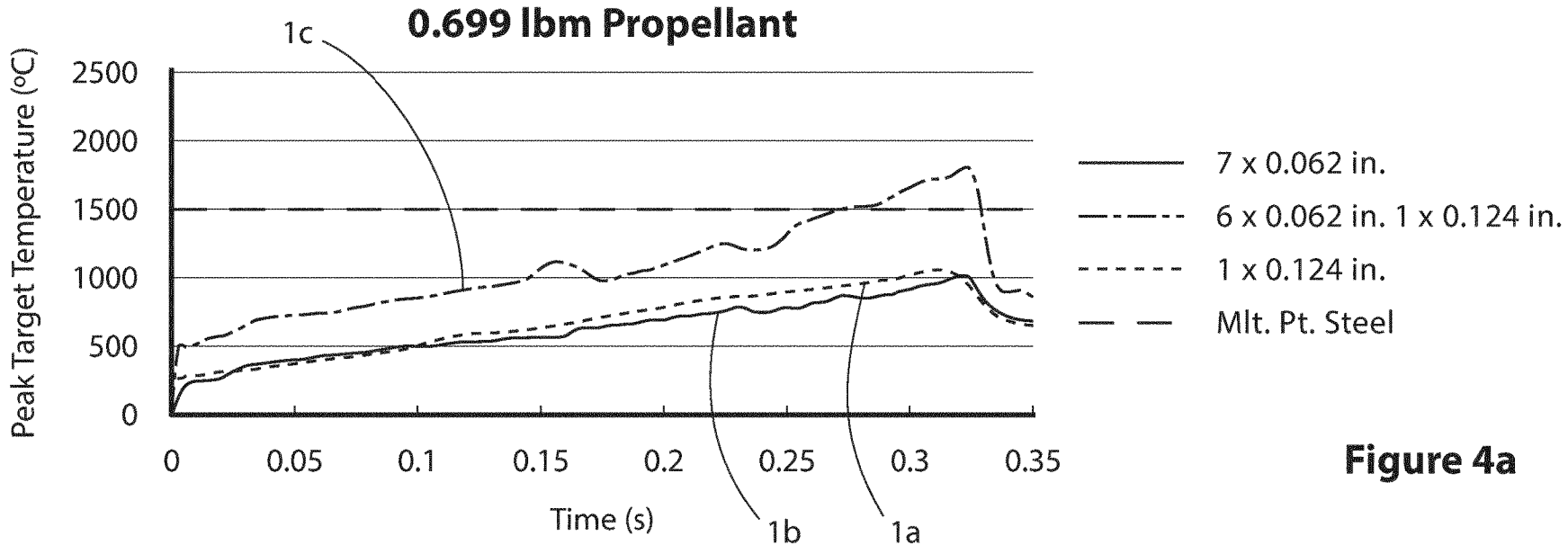
FIGS. 4*a* and 4*b* show graphs from further simulations.
Figure 4B:
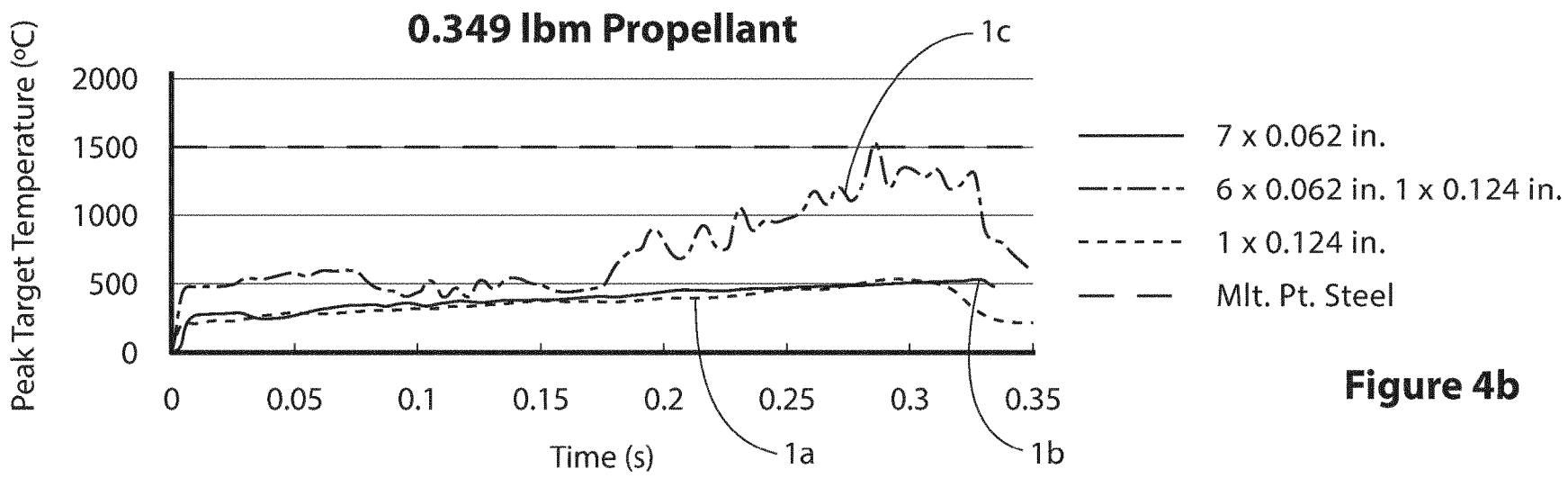

FIGS. 4*a* and 4*b* show the same simulations carried out with reduced charges of propellant (0.699 pounds and 0.349 pounds respectively). The combustion duration remains at about 0.34 seconds. In these conditions the arrangement of FIG. 1*c* continues to provide significant improvement in target temperature, the arrangements of FIGS. 1*a* and 1*b* appear comparable at these reduced combustion rates.

Figure 5:
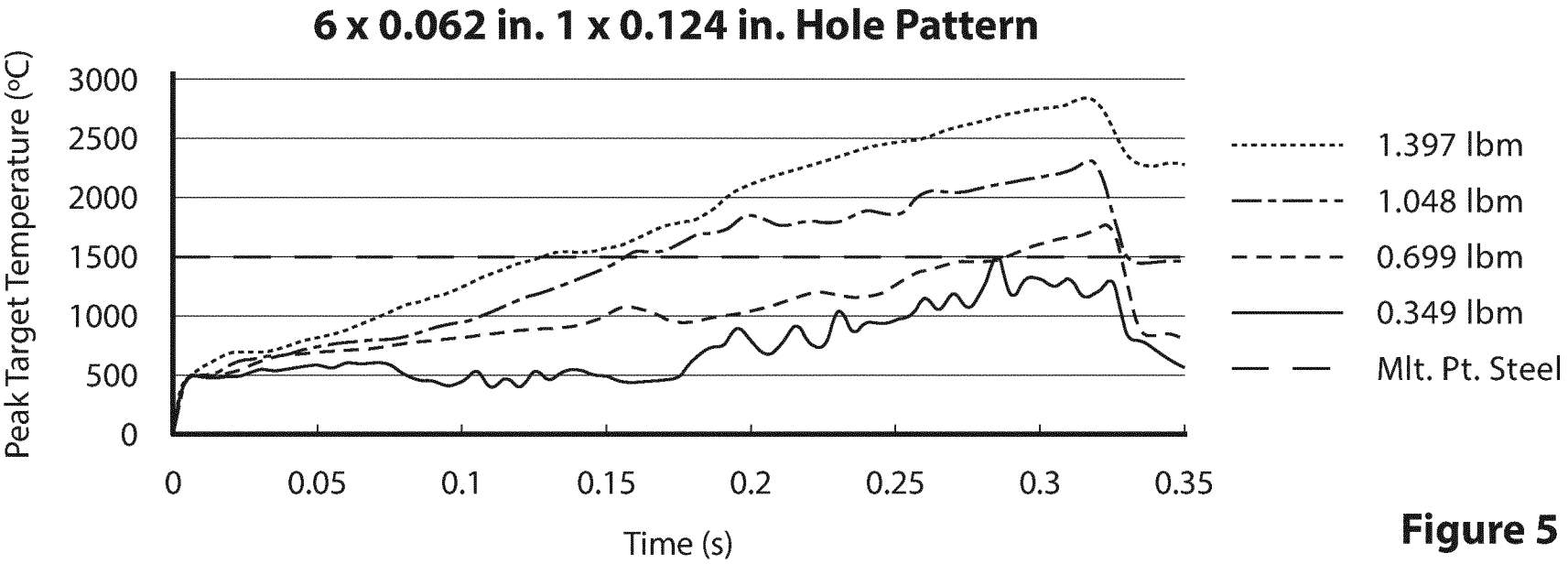
FIG. 5 shows graphs from further simulations using a nozzle configuration with different charges of propellant.

FIG. 5 shows use of the arrangement of FIG. 1*c* with four different propellant charge masses, the three charges depicted in FIGS. 3, 4*a* and 4 and a higher charge (1.397 pounds). The higher mass charge shows even further improvement in performance with time.

Figure 6:
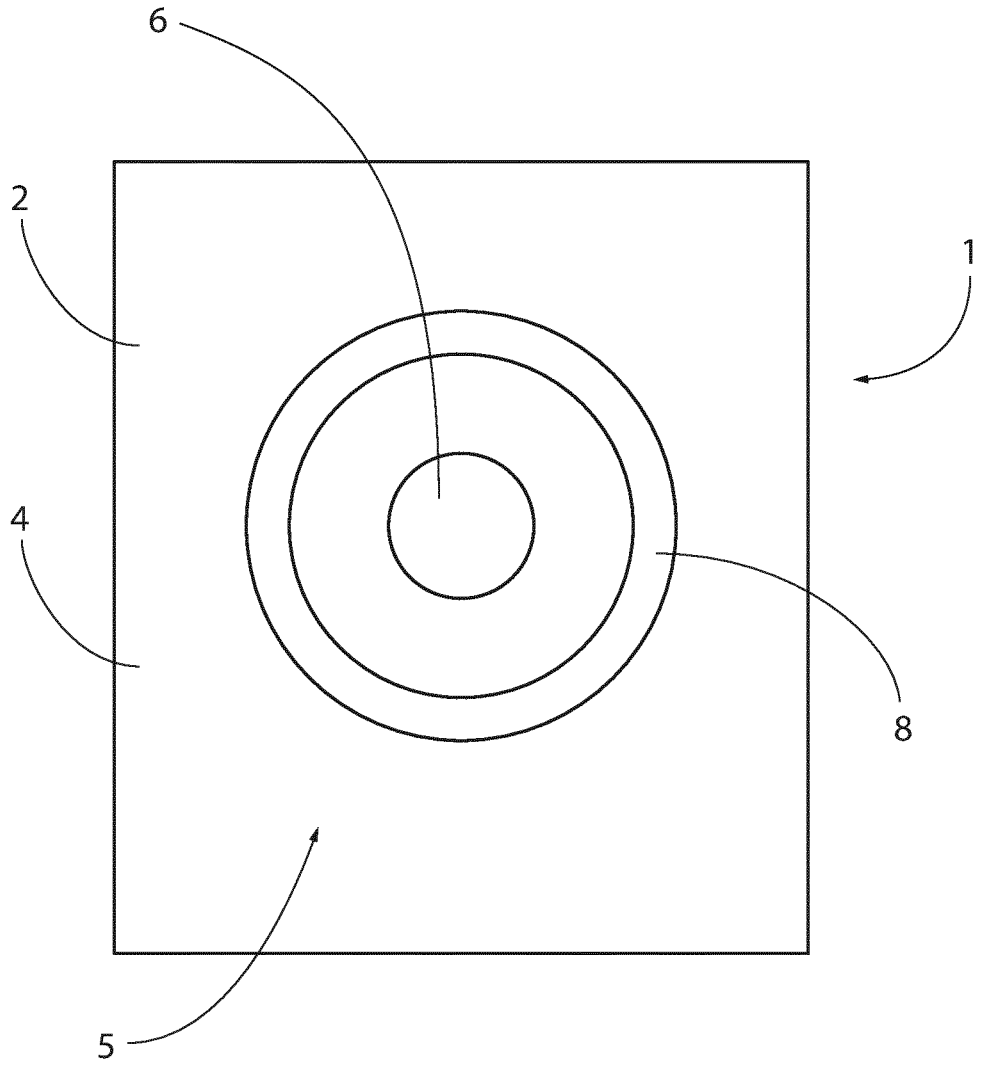
FIG. 6 shows in schematic elevation a portion of the exterior surface of the housing of a downhole tool.

FIG. 6 shows in schematic elevation a portion of the exterior surface of the housing 2 of a downhole tool 1, that may be a perforator of generally the same for as that discussed with reference to FIGS. 1 to 5. The depicted outlet 5 of the tool has a single principal exit port 6 and one secondary exit port 8. The secondary exit port 8 is provided as a slit encircling the principal exit port 6.

Figure 8:
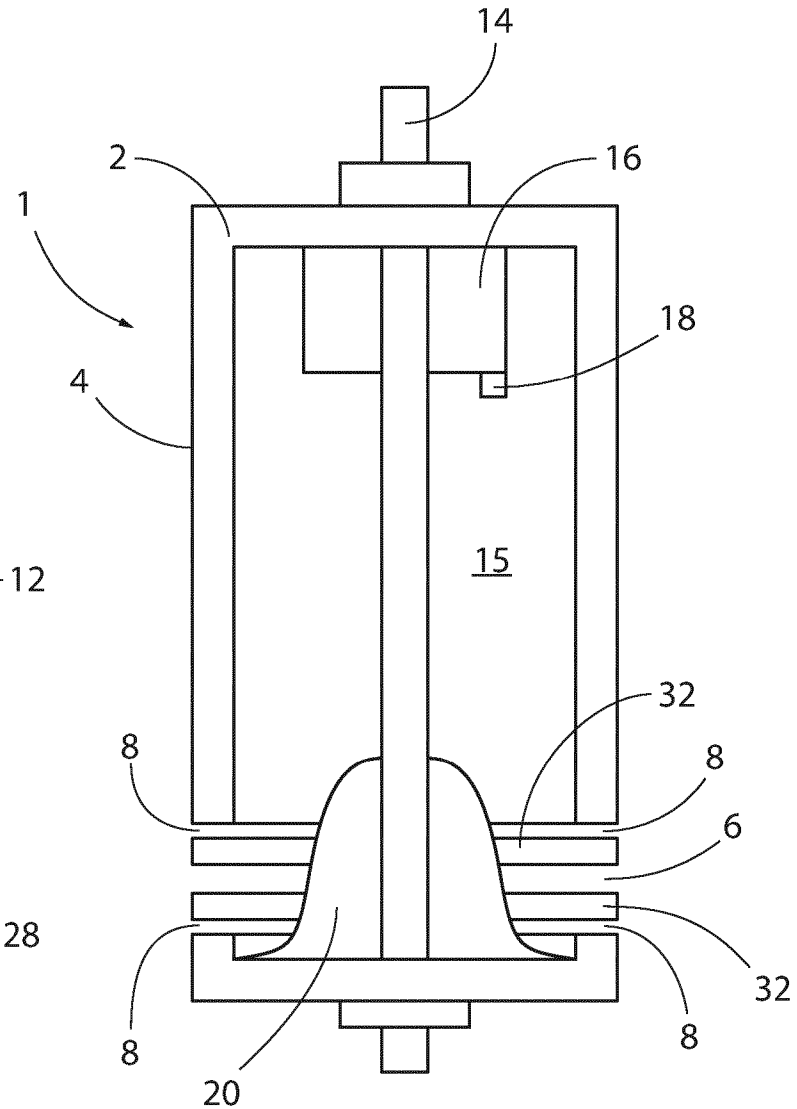
FIG. 8 shows another tool for severing a tubular in schematic cross section.
Figure 7:
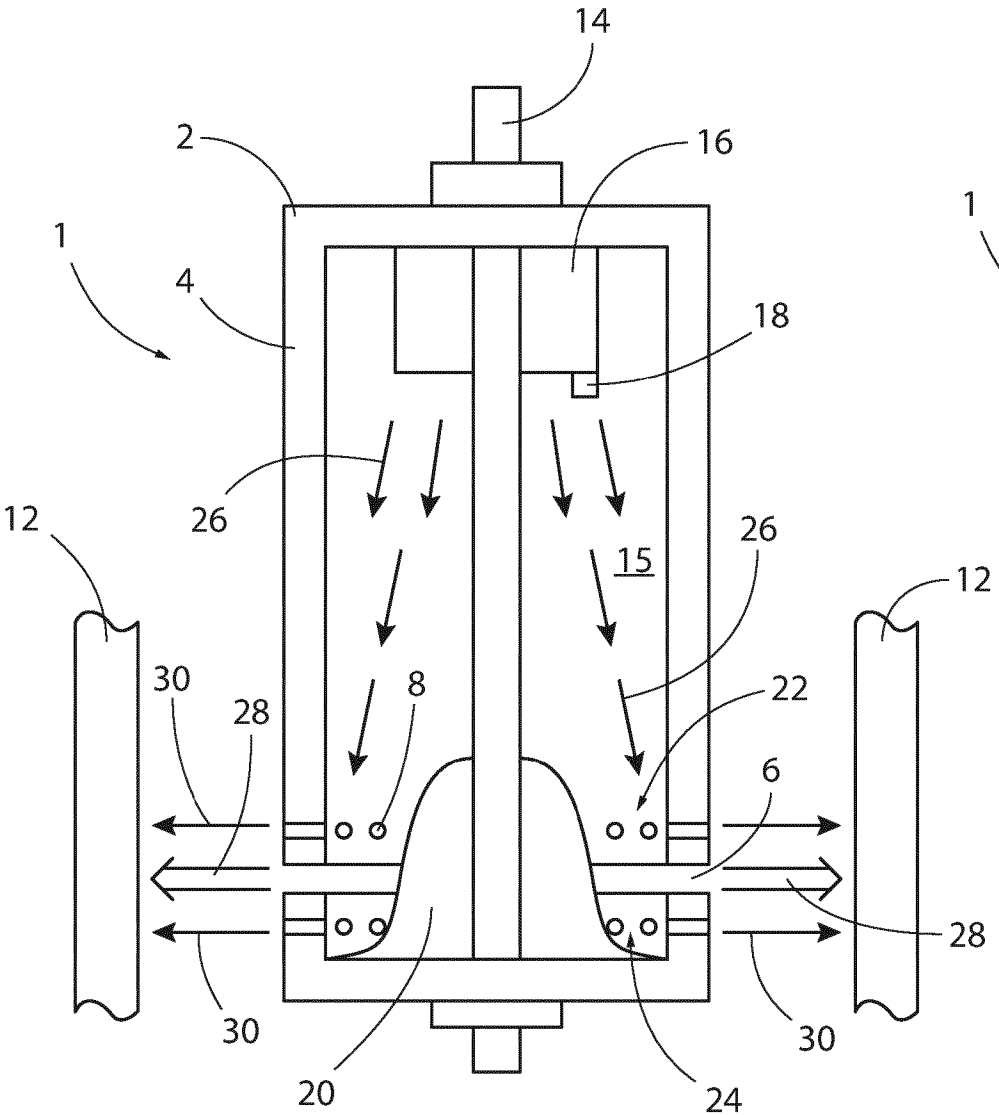
FIG. 7 shows in schematic cross section the interior of a generally cylindrical tool for severing a tubular.

FIGS. 7 and 8 show downhole tools for severing a tubular or other structure.

FIG. 7 shows in schematic cross section the interior of a generally cylindrical tool 1 comprising a housing 2 with an external surface 4. A central bolt 14 holds the housing parts together and mounts various components within a chamber 15 including a block of solid propellant 16 as propellant source, an ignition system 18 for the propellant (wiring connections to surface not shown), and a deflector 20. A circumferential slit in the housing is provided as a principal exit port 6 for combustion products from the propellant. Above and below the principal exit port 6 are two circumferential arrays 22, 24 of secondary exit ports 8 in the form of circular holes through housing 2.

Before ignition of the propellant 16 the exit ports 6, 8 may be sealed by a fusible material such as a relatively low melting point metal.

As suggested by arrows 26, after ignition of propellant block 16 the combustion products generated fill and pressurise the chamber 15, exiting through the exit ports 6, 8 with the aid of deflector 20. On exiting the tool the jet of combustion products 28 from the principal exit port 6 is shrouded by the jets 30 emanating from the secondary exit ports 8 as it attacks the target tubular 12.

FIG. 8 shows a tool of the same general form as that of FIG. 7 with like parts numbered the same. In this example the secondary exit ports 8 are provided in the form of circumferential slits. The portions 32 of the housing 2 between the principal and secondary exit ports are mounted to the central bolt 14 by radially extending 'spokes' connecting to deflector 20 (not shown in the drawing for clarity).

Figure 9A:
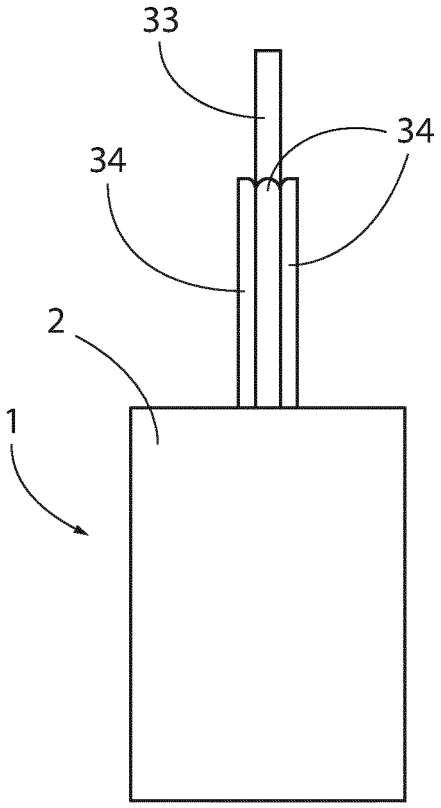
FIGS. 9*a* and 9*b* show schematically a tool fitted with a centring mechanism.
Figure 9B:
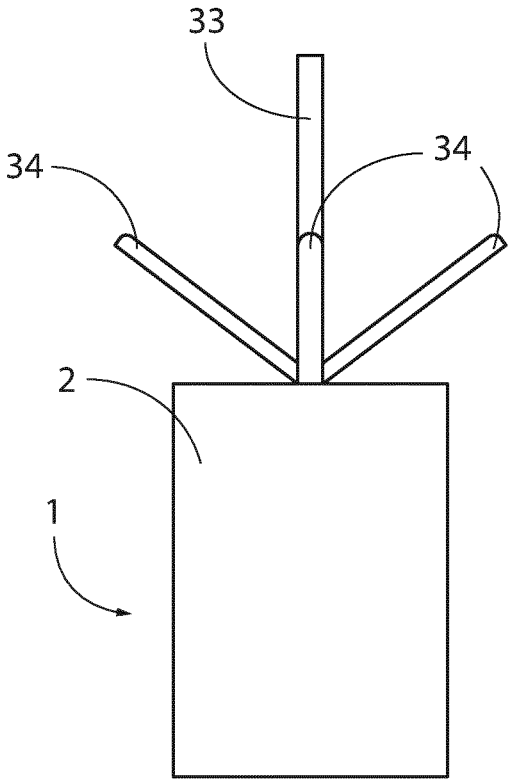

FIGS. 9*a* and 9*b* show schematically a tool 1 with a cylindrical housing 2. Mounted on a rod 33 above housing 2 are the arms 34 of a centring mechanism. In FIG. 9*a* the arms 34 are stowed in general alignment with the axial length of the housing 2. As shown in FIG. 9*b*, when deployed, the arms 34 pivot outwards to a diameter greater than that of housing 2, for contact with the walls of a wellbore or a tubular within the wellbore. This can centre the tool 1 in the diameter of the wellbore or a tubular within the wellbore.

Figure 10:
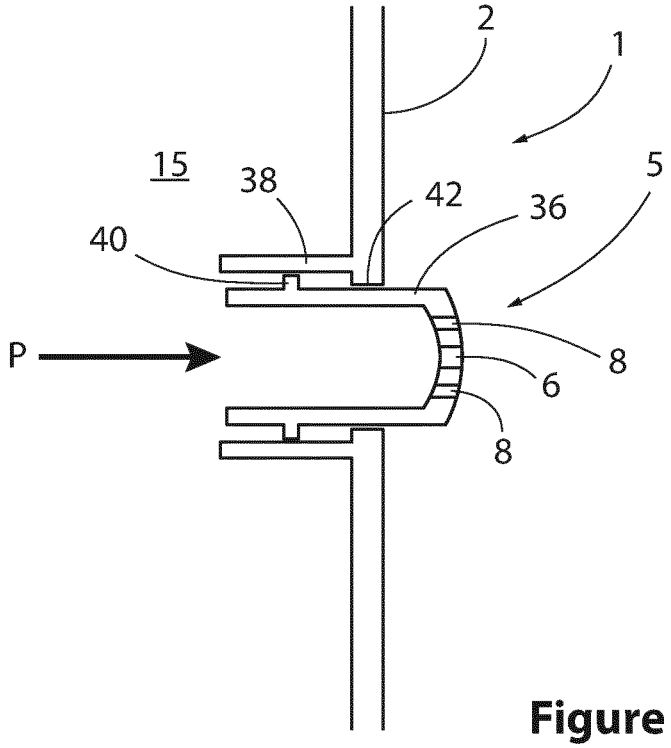
FIG. 10 shows schematically in part cross section, part of the housing 2 of a tool 1.

FIG. 10 shows schematically in part cross section, part of the housing 2 of a tool 1. In this example the principal exit port 6 and associated secondary exit ports 8 are provided on a piston 36 moveable in a radially directed cylinder 38 that is provided as part of housing 2. As shown in the figure piston 36 is being moved by the pressure of combustion products in the chamber 15 (arrow P) along cylinder 38 towards a final position where respective circumferential flanges 40 and 42 contact. Thus the exit ports 6, 8 can be moved closer to a target i.e. the "stand-off" distance can be reduced.

The invention claimed is:

1. A tool for manipulating a target with combustion products from a propellant, wherein the propellant is a generally explosive material which has a low rate of combustion and once ignited produces propellant gas via at least one of burning, decomposing, or deflagrating, the tool comprising:

a housing comprising at least one outlet for combustion products from at least one propellant source contained within the housing;

an ignition mechanism for igniting the propellant at the propellant source;

wherein the outlet comprises a plurality of exit ports on a surface of the tool configured, when open, to direct combustion products at a target;

the plurality of exit ports comprising a principal exit port and one or more secondary exit ports, the secondary exit port or ports being spaced apart from and at least partly surrounding the principal exit port, wherein the secondary exit port or ports are arranged relative to the principal exit port such that, in use of the tool, a jet or jets of combustion products emanating from the secondary exit port or ports substantially surround or surround, thereby shrouding, a jet of combustion products emanating from the principal exit port, wherein the plurality of exit ports are sealed, before use by a fusible material, such that after ignition the fusible material is melted by heat generated, thereby opening the exit ports.

2. The tool of claim 1 wherein the housing defines one or more chambers and the propellant source or sources are located within the chamber or chambers.

3. The tool of claim 2 wherein the secondary exit port or ports of the at least one outlet are fed with combustion products from the same chamber as provides combustion products to the principal exit port.

4. The tool of claim 1 wherein there is more than one outlet and each outlet is fed with combustion products from a single chamber.

5. The tool of claim 1 wherein the manipulation of a target comprises at least one of:

a change in temperature, structure, position, composition, phase, physical properties and/or condition of the material of the target.

6. The tool of claim 5 wherein the target is a tubular and the manipulation of the target comprises perforation or severing of the tubular.

7. The tool of claim 1 wherein each outlet includes a principal exit port comprising a hole through the housing and secondary exit ports are provided in the form of an array of ports comprising holes spaced apart from the principal exit port and distributed around it.

8. The tool of claim 7 wherein the secondary exit ports are provided as a circular array distributed about the principal exit port.

9. The tool of claim 1 wherein each outlet includes a principal exit port comprising a hole through the housing and a secondary exit port that comprises a slit in the housing that extends about the principal exit port.

10. The tool of claim 1 wherein the principal exit port comprises a circumferential slit, extending around the housing of the tool.

11. The tool of claim 1 wherein the plurality of exit ports are moveable radially outwards from a stowed position to a deployed position.

12. The tool of claim 11 wherein the principal exit port and its associated secondary exit port or ports are mounted to a part of the housing that can move radially outwards.

13. The tool of claim 12 wherein the moving part of the housing takes the form of a piston moving in a radially directed cylinder of the housing.

14. The tool of claim 13 wherein movement of the piston is by pressure generated by combustion products generated in a chamber of the housing.

15. A method for manipulating a target, the method comprising:

deploying a tool for manipulating a target, adjacent to the target, wherein the tool is as defined in claim 1; and igniting the propellant source or sources to melt fusible material sealing the plurality of exit ports and generate combustion products that are directed at the target as they exit from the principal and secondary exit ports.

16. The tool of claim 1, wherein the fusible material is a metal with low melting point.

17. A tool for manipulating a target with combustion products from a propellant, the tool comprising:

a housing comprising at least one outlet for combustion products from at least one propellant source contained within the housing;

an ignition mechanism for igniting propellant at the propellant source;

wherein the outlet comprises a plurality of exit ports on a surface of the tool configured to direct combustion products at a target;

the plurality of exit ports comprising a principal exit port and two secondary exit ports, the secondary exit ports being spaced apart from and at least partly surrounding the principal exit port, wherein the principal exit port comprises a circumferential slit, extending around the housing of the tool and the two secondary exit ports, each comprise circumferential or substantially circumferential slits displaced axially, to either side of the principal exit port, on the housing.

18. A tool for manipulating a target with combustion products from a propellant, the tool comprising:

a housing comprising at least one outlet for combustion products from at least one propellant source contained within the housing;

an ignition mechanism for igniting propellant at the propellant source;

wherein the outlet comprises a plurality of exit ports on a surface of the tool configured to direct combustion products at a target;

the plurality of exit ports comprising a principal exit port and two secondary exit ports, the secondary exit ports being spaced apart from and at least partly surrounding the principal exit port, wherein the principal exit port comprises a circumferential slit, extending around the housing of the tool and the two secondary exit ports, each comprise an array of holes extending circumferentially about the housing and axially displaced to either side of the principal exit port.

* * * * *